US006231400B1

(12) United States Patent
Nagai

(10) Patent No.: US 6,231,400 B1
(45) Date of Patent: May 15, 2001

(54) COMBINED-TYPE CONNECTOR

(75) Inventor: Kentaro Nagai, Shizouka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/516,251

(22) Filed: Mar. 1, 2000

(30) Foreign Application Priority Data

Mar. 1, 1999 (JP) ..... 11-053219

(51) Int. Cl.[7] ..... H01R 13/514
(52) U.S. Cl. ..... 439/701
(58) Field of Search ..... 439/701, 717, 439/541.5

(56) References Cited

U.S. PATENT DOCUMENTS 5,895,296 * 8/1999 Okabe ..... 439/701
5,934,944 * 8/1999 Aoyama ..... 439/717
6,000,971 * 12/1999 Hatagishi et al. ..... 439/701
6,050,859 * 4/2000 Abe et al. ..... 439/701
6,059,612 * 5/2000 Aoyama et al. ..... 439/701
6,068,522 * 5/2000 Aoyama ..... 439/701

* cited by examiner

*Primary Examiner*—Brian Sircus
*Assistant Examiner*—J. F. Duverne
(74) *Attorney, Agent, or Firm*—Morgan, Lewis & Bockius LLP

(57) ABSTRACT

In a combined-type connector 20, a plurality of terminal storage chambers 23, each receiving a terminal 26 therein, are formed in an upper connector housing 21, and a plurality of partition walls 24, separating the terminal storage chambers 23 from one another, are formed on the upper connector housing. A plurality of partition walls are formed on the lower connector housing so as to be opposed to the partition walls 24, respectively. In accordance with the movement of the two connector housings 21 and 22 toward a connecting position, the partition walls 24 are moved respectively toward the mating partition walls, and in the connecting position of the two connector housings, distal end surfaces of said partition walls 24 are substantially abutted respectively against distal end surfaces of the mating partition walls. A positioning lock projection portion 36 is formed on a connecting surface 22*a* of the lower connector housing 22, and continuously extends in a direction of extending of the partition walls 24, and a positioning recess 29, in which the positioning lock projection portion 36 can be fitted, is formed in a connecting surface 21*a* of the upper connector housing 21.

6 Claims, 5 Drawing Sheets

COMBINED-TYPE CONNECTOR

BACKGROUND OF THE INVENTION

This invention relates to a combined-type connector in which a plurality of connector housings, each having a plurality of terminals received therein, are connected together in a multi-stage manner to provide the combined-type connector.

FIGS. 4 to 8 show a combined-type connector (see Japanese Patent Application No. 9-223764). FIG. 4 is a perspective view of this combined-type connector, which shows a condition before it is brought into a combined condition. FIG. 5 is an enlarged, perspective view of an important portion of an upper connector housing as viewed from the lower side thereof. FIG. 6 is an enlarged, perspective view of an important portion of a lower connector housing as viewed from the upper side thereof. FIG. 7 is a cross-sectional view of an important portion, which shows a condition in which press-connecting terminals are held in contact with partition walls. FIG. 8 is a cross-sectional view of an important portion, which shows a condition in which the press-connecting terminal is pressed and deformed by the partition wall.

In FIGS. 4 to 8, the combined-type connector 1 includes the upper connector housing 2, and the lower connector housing 3, and a lower surface 2*a* of the upper connector housing 2 and an upper surface 3*a* of the lower connector housing 3 serve respectively as connecting surfaces opposed to each other. A plurality of terminal storage chambers 4 are formed in the upper connector housing 2, and extend in a forward-rearward direction, and are juxtaposed in a right-left direction. These terminal storage chambers 4 are separated from one another by the partition walls 5 (shown in FIGS. 7 and 8). A rear portion of the lower surface (connecting surface) 2*a* of the upper connector housing 2 is open to provide an opening 6, and rear portions of the terminal storage chambers 4 are exposed through this opening 6. The press-connecting terminals 7 (shown in FIGS. 7 and 8) are received in the terminal storage chambers 4, respectively, and one end portion of a wire W is press-connected to a wire press-connecting portion 7*a* formed at a rear portion of each press-connecting terminal 7. The wire press-connecting portion 7*a* is bent into a generally U-shape, and distal ends of opposed side walls thereof project upwardly beyond the partition walls 5.

On a front portion of the lower surface (connecting surface) 2*a* of the upper connector housing 2, three first front retaining projections 8 of a generally trapezoidal cross-section are formed to extend in the forward-rearward direction, one of these projections 8 being disposed at a central portion of this front portion whereas the other two projections 8 are disposed respectively on opposite sides of this central projection 8, and are spaced a predetermined distance therefrom. Second front retaining projections 9 are formed respectively on opposite ends of the front portion of the lower surface 2*a* of the upper connector housing 2. As best shown in FIG. 5, each second front retaining projection 9 includes a downwardly-extending, introducing rib 9*a* of a semi-circular shape, an introducing tapering convex portion 9*b* extending obliquely from a distal end of the introducing rib 9*a*, and a flat convex portion 9*c* extending horizontally from the bottom of the introducing tapering convex portion 9*b*. Rear retaining projections 10, each in the form of an engagement pole, are provided respectively on opposite side surfaces of the upper connector housing 2 at the rear portion thereof.

A plurality of terminal storage chambers 4 are formed in the lower connector housing 3, and extend in the forward-rearward direction, and are juxtaposed in the right-left direction. A rear portion of a lower surface of the lower connector housing 3 is open to provide an opening 6, and rear portions of the terminal storage chambers 4 are exposed through this opening 6. Similarly the upper connector housing 2, press-connecting terminals (not shown) are received in the terminal storage chambers 4 of the lower connector housing 3, respectively.

A cover 11 is connected to the lower side of the lower connector housing 3 through hinge portions (not shown). The opening 6 can be closed by this cover 11. A plurality of partition walls 12 are formed on a rear portion of the upper surface (connecting surface) 3*a* of the lower connecting housing 3 so as to be opposed respectively to the plurality of partition walls 5 on the upper connector housing 2. A wire position-limiting projection 13 (shown in FIGS. 7 and 8) is formed between any two adjacent partition walls 12.

Three first front retaining recesses 14 of a generally inverted trapezoid-shaped cross-section are formed in a front portion of the upper surface (connecting surface) 3*a* of the lower connector housing 3, one of these recesses 14 being disposed at a central portion of this front portion whereas the other two recesses 14 are disposed respectively on opposite sides of this central recess 14, the other recesses 14 are spaced a predetermined distance therefrom. Second front retaining recesses 15 are formed respectively in opposite ends of the front portion of the upper surface 3*a* of the lower connector housing 3. As best shown in FIG. 6, each second front retaining recess 15 includes a guide tapering recess portion 15*a* for receiving the introducing rib 9*a* and the introducing tapering convex portion 9*b*, and a horizontal recess portion 15*b* for receiving the flat convex portion 9*c*. Rear retaining arms 16 of an elastic nature are formed respectively on opposite side surfaces of the lower connector housing 3 at the rear portion thereof, and each of the rear retaining arms 16 has a rear retaining hole 17.

In the above construction, the press-connecting terminals 7 are received respectively in the terminal storage chambers 4 formed in the connector housings 2 and 3, and the wire W is connected at one end portion to each of the press-connecting terminals 7, and thereafter the opening 6 in the lower connector housing 3 is closed by the cover 11. Then, the upper connector housing 2 is set on a combining jig (not shown), with its lower surface 2*a* directed upwardly, and then the lower connector housing 3 is placed on the thus set upper connector housing 2 from the upper side, with the upper surface 3*a* thereof directed downwardly. When placing the lower connector housing on the upper connector housing, the first front retaining projections 8, the second front retaining projections 9 and the rear retaining projections 10 of the upper connector housing 2 are generally positioned with respect to the first front retaining recesses 14, the second front retaining recesses 15 and the rear retaining arms 16 of the lower connector housing 3, respectively.

Then, the lower connector housing 3 is pressed downwardly, so that the opposed connecting surfaces of the two connector housings 2 and 3 are moved toward each other, and therefore in this connecting position, the first front retaining projections 8 and the second front retaining projections 9 are fitted into the first front retaining recesses 14 and the second front retaining recesses 15, respectively. Also the rear retaining projections 10 are retainingly engaged respectively in the rear retaining holes 17 since the rear retaining arms 16 are elastically deformed. Therefore, the two connector housings 2 and 3 are combined together.

In accordance with the movement of the two connector housings 2 and 3 toward the connecting position, the partition walls 12 are moved toward the partition walls 5, respectively, and are substantially held against the partition walls 5 at their respective distal ends. Therefore, the terminal storage chambers 4 are substantially completely separated or isolated from one another, and the short-circuiting between the adjacent press-connecting terminals 7 is prevented.

In the above general combined-type connector, however, the positioning of the two connector housings 2 and 3 relative to each other during the connecting operation is unstable. Namely, the positioning of the front portions of the two connector housings 2 and 3 in the right-left direction is effected by inserting the first front retaining projections 8 into the respective first front recesses 14, and the positioning of these front portions in the forward-rearward direction is effected by inserting the second front retaining projections 9 into the respective second front recesses 15, and therefore there is no problem. However, the positioning of the rear portions of the two connector housings 2 and 3 is effected only by engaging the rear retaining projections 10 respectively with the elastically-deformable rear retaining arms 16, and therefore these rear portions can be easily displaced in the right-left direction which is the direction of elastic deformation of the rear retaining arms 16.

When the two connector housings 2 and 3 are moved toward the connecting position, with the lower connector housing 3 displaced in the right-left direction from the proper position, the partition walls 12 of the lower connector housing 3 abut against the wire press-connecting portions 7*a* of the press-connecting terminals 7 as shown in FIG. 7, and the wire press-connecting portions 7*a* are bent by a pressing force applied from the partition walls 12. When the wire press-connecting portion 7*a* of the press-connecting terminal 7 is bent outwardly as shown in FIG. 8, there is a fear that this wire press-connecting portion 7*a* contacts the adjacent press-connecting terminal 7, thus causing the short-circuiting.

SUMMARY OF THE INVENTION

The present invention has been made in order to solve the above problem, and an object of the invention is to provide a combined-type connector in which the short-circuiting between adjacent terminals during a connecting operation is prevented.

According to the present invention, there is provided a combined-type connector comprising:

at least first and second connector housings being respectively provided with first and second terminal storage chambers, said first and second connector housings being adapted to stack one on the other and having respective first and second connecting surface opposed to each other when said first and second connector housing are connected together;

first partition walls, on said first connecting housings, for defining said first terminal storage chambers;

second partition walls, on said second connecting housings, for defining said second terminal storage chambers;

first distal end surfaces of said first partition walls substantially abutted respectively against second distal end surfaces of said second partition walls when said first and second connector housing are connected together;

at least one positioning lock projection portion formed on said first connecting surface, said positioning lock projection portion extending in a direction in which each said first partition walls extend, said positioning lock projection portion extending over at least a region where said first partition walls are substantially abutted against said second partition walls respectively;

at least one positioning recess portion formed on said second connecting surface, said positioning recess portion extending in said direction, said positioning recess portion, engageable with said at least one positioning lock projection portion, extending over at least a region where said second partition walls are substantially abutted against said first partition walls respectively.

In this combined-type connector, when the opposed connecting surfaces of connector housings are moved toward each other, the positioning lock projection portion, formed on the connecting surface of one of the connector housings, is gradually continuously inserted into the positioning recess formed in the connecting surface of the other connector housing. Since the positioning lock projection portion is thus continuously inserted into the positioning recess, the connector housings are moved to the connecting position without being displaced in a direction perpendicular to the direction of extending of the partition walls, and therefore the partition walls on the one of the connector housing are moved respectively toward the partition walls on the another connector housing without being displaced relative thereto.

In the combined-type connector of the invention, the positioning lock projection portion is gradually decreasing in width from its distal end surface to its proximal portion, and the positioning recess is gradually increasing in width from its open side to its bottom.

In this combined-type connector, the positioning lock projection portion, gradually decreasing in width from its distal end surface to its proximal portion, is fitted in the positioning recess gradually increasing in width from its open side to its bottom.

DETAILED DESCRIPTION OF PREFERRED EMBODIMENTS

One preferred embodiment of the present invention will now be described with reference to the drawings.

Figure 1:
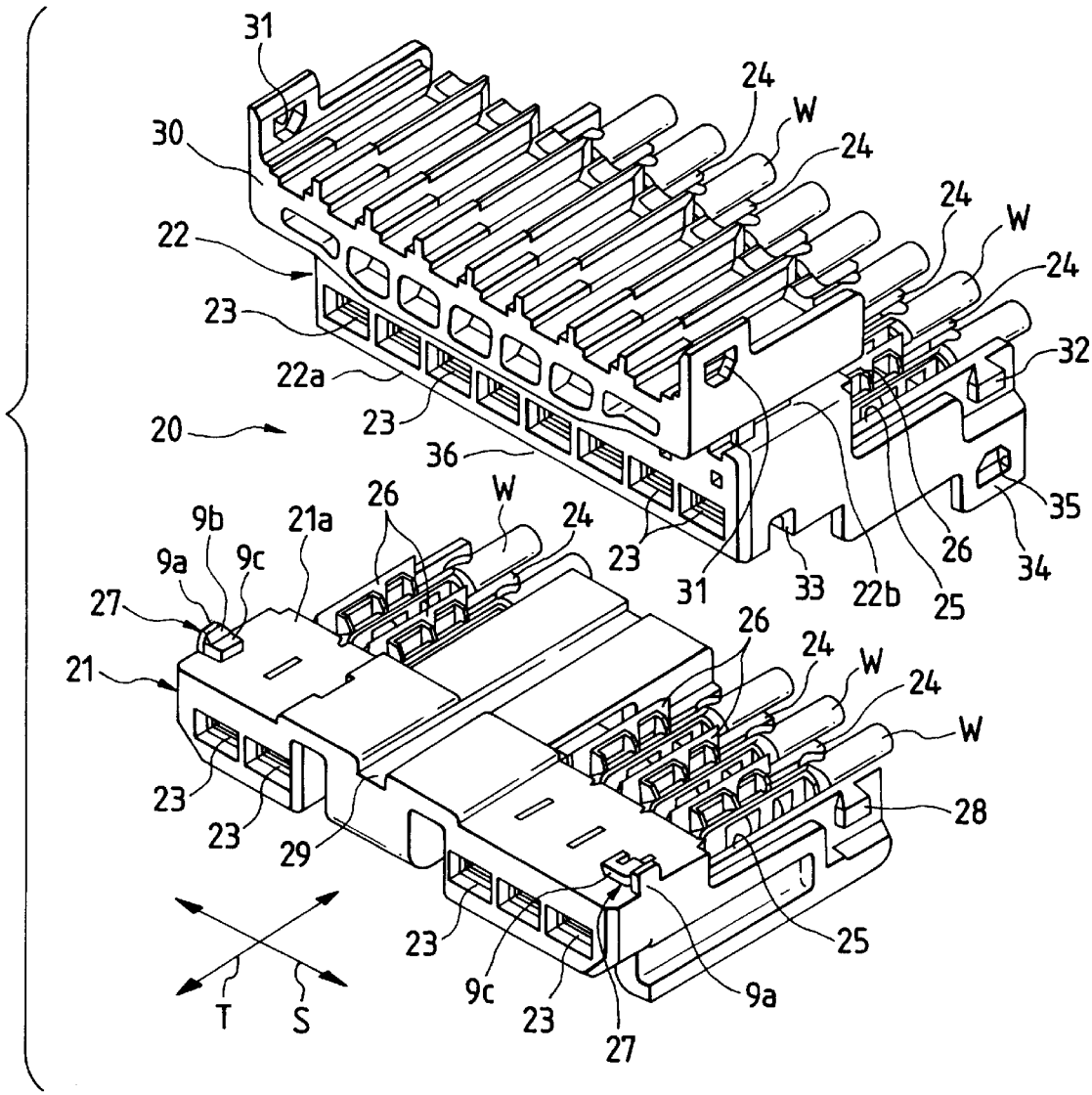
FIG. 1 is a perspective view of one preferred embodiment of a combined-type connector of the present invention, showing a condition before it is brought into a combined condition.
Figure 2:
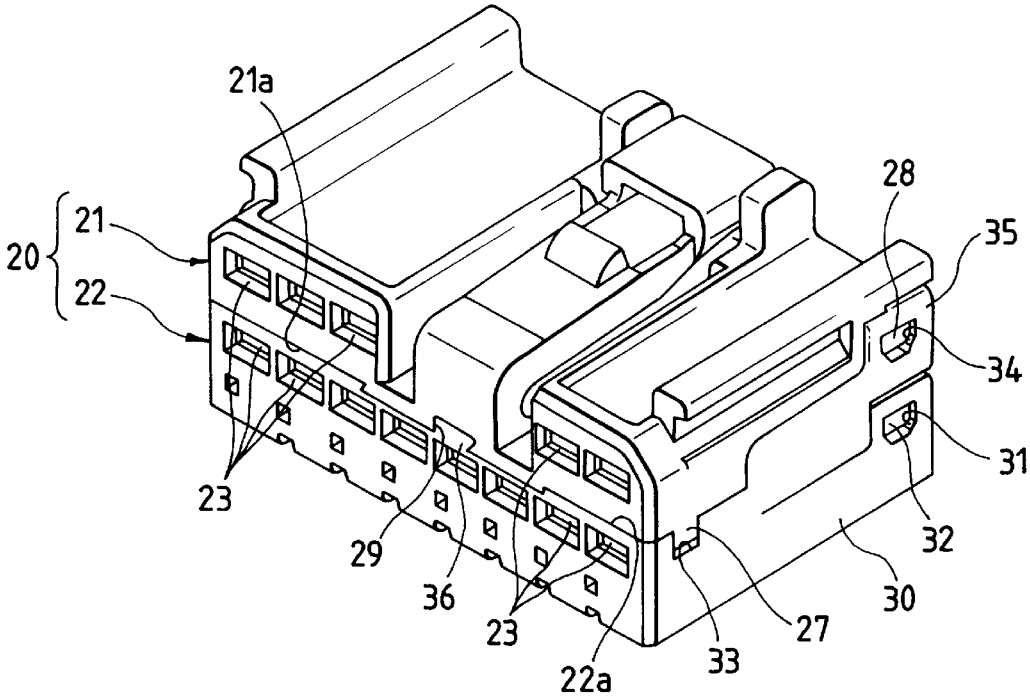
FIG. 2 is a perspective view showing the combined-type connector of this embodiment in its combined condition.
Figure 3:
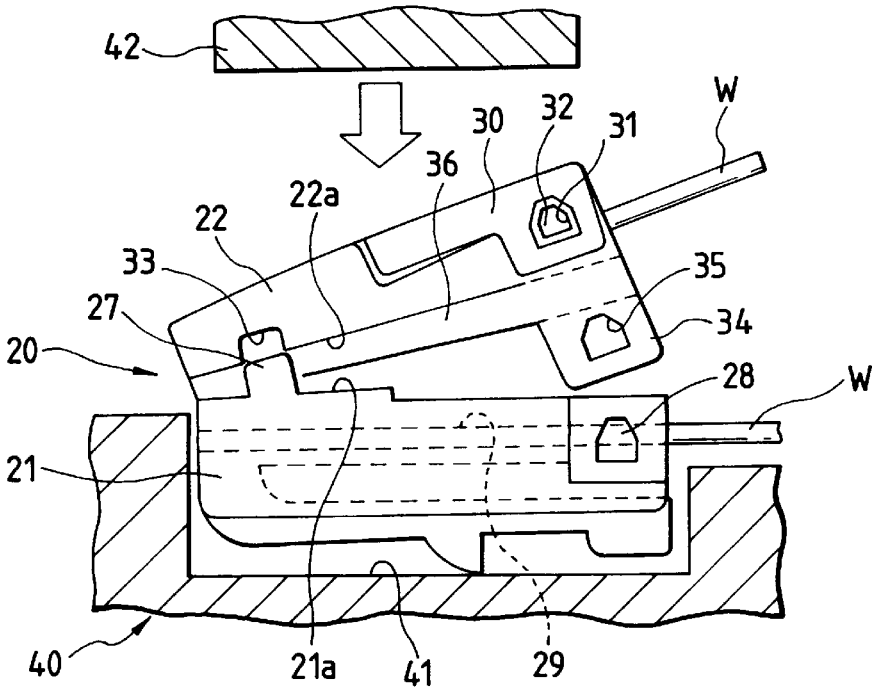
FIG. 3 is a side-elevational view showing a process of combining the combined-type connector of this embodiment.
Figure 4:
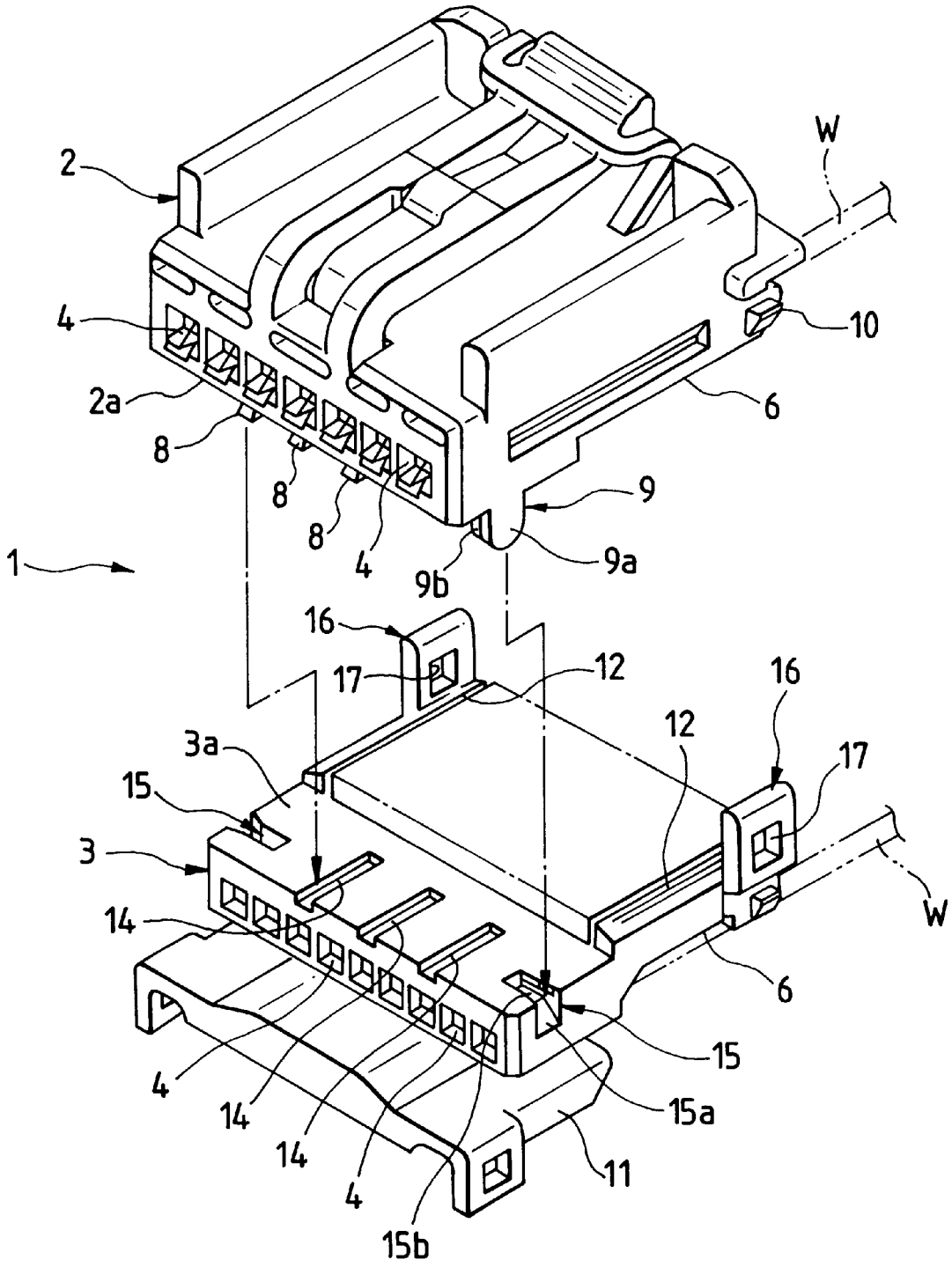
FIG. 4 is a perspective view of a general combined-type connector, showing a condition before it is brought into a combined condition.
Figure 5:
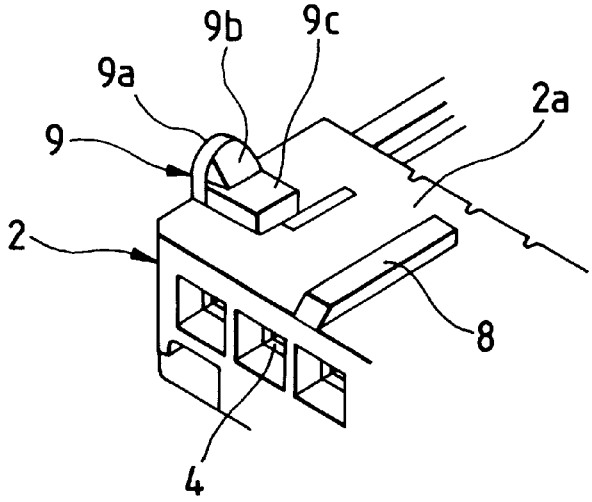
FIG. 5 is an enlarged, perspective view of an important portion of an upper connector housing of the general connector as viewed from the lower side thereof.
Figure 6:
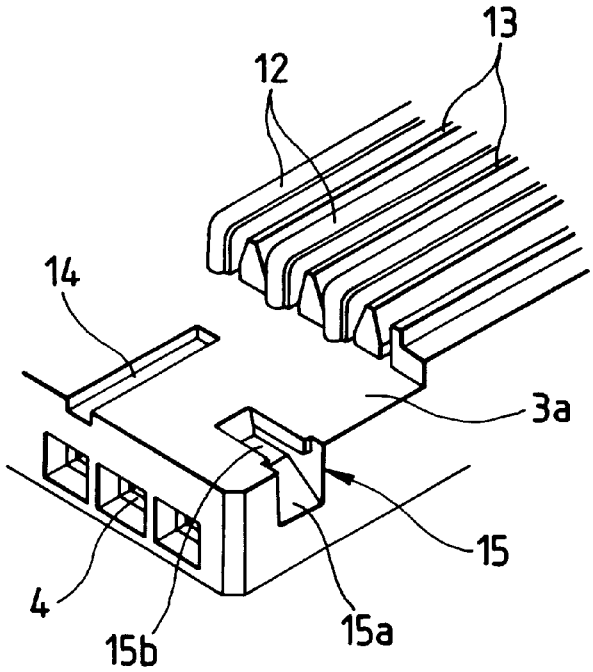
FIG. 6 is an enlarged, perspective view of an important portion of a lower connector housing of the general connector as viewed from the upper side thereof.
Figure 7:
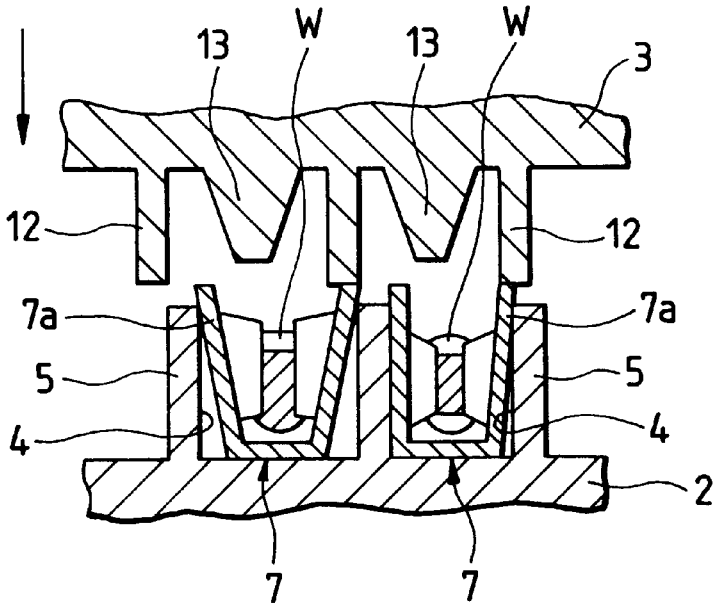
FIG. 7 is a cross-sectional view of an important portion of the general connector, showing a condition in which press-connecting terminals are held in contact with partition walls.
Figure 8:
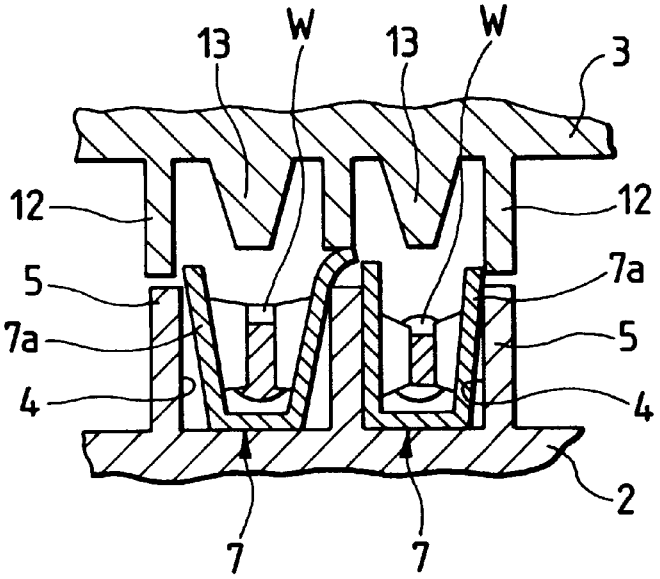
FIG. 8 is a cross-sectional view of an important portion of the general connector, showing a condition in which the press-connecting terminal is pressed and deformed by the partition wall.

FIG. 1 is a perspective view of one preferred embodiment of a combined-type connector of the invention, showing a condition before it is brought into a combined condition, FIG. 2 is a perspective view showing the combined-type connector in its combined condition, and FIG. 3 is a side-elevational view showing a process of a combining operation. In FIG. 1, for better understanding of a connecting operation, a lower connector housing 22 is shown as disposed above an upper connector housing 21, and lower surfaces of the two connector housings 21 and 22 are directed upwardly.

In FIGS. 1 to 3, the combined-type connector 20 includes the upper connector housing (one connector housing) 21, and the lower connector housing (the other connector housing) 22, and the lower surface 21*a* of the upper connector housing 21 and the upper surface 22*a* of the lower connector housing 22 serve respectively as connecting surfaces opposed to each other. A plurality of terminal storage chambers 23 are formed in the upper connector housing 21 except a central portion thereof, and extend in a forward-rearward direction, and are juxtaposed in a right-left direction, and these terminal storage chambers 23 are separated from one another by partition walls 24.

A rear portion of the lower surface (connecting surface) 21*a* of the upper connector housing 21 is open to provide an opening 25, and rear portions of the terminal storage chambers 23 are exposed through this opening 25. Press-connecting terminals 26 are received in the terminal storage chambers 23, respectively, and one end portion of a wire W is press-connected to a wire press-connecting portion (not designated by a reference numeral) formed at a rear portion of each press-connecting terminal 26. The wire press-connecting portion is bent into a generally U-shape, and distal ends of opposed side walls thereof project upwardly beyond the partition walls 24.

Front retaining projections 27 are formed respectively at opposite ends of the front portion of the lower surface (connecting surface) 21*a* of the upper connector housing 21. The front retaining projection 27 is identical in construction to the second front retaining projection 9 of the general structure, and therefore corresponding portions of the front retaining projection 27 will be designated by identical reference numerals used for the second front retaining projection 9, and explanation thereof will be omitted. Rear retaining projections 28, each in the form of an engagement pole, are provided respectively on opposite side surfaces of the upper connector housing 21 at the rear portion thereof.

A positioning recess 29 is formed in a central portion of the lower surface (connecting surface) of the upper connector housing 21, and extends from the front side thereof to the rear side thereof in a direction (forward-rearward direction) T of extending of the partition walls 24. This positioning recess 29 is in the form of a dovetail groove gradually increasing in width from its open side to its bottom.

A plurality of terminal storage chambers 23 are formed in the lower connector housing 22, and extend in the forward-rearward direction, and are juxtaposed in the right-left direction. A rear portion of the lower surface 22*b* of the lower connector housing 22 is open to provide an opening 25, and rear portions of the terminal storage chambers 23 are exposed through this opening 25. As described above for the upper connector housing, press-connecting terminals 26 are received in the terminal storage chambers 23, respectively.

A cover 30 is connected to the lower side 22*b* of the lower connector housing 22 through hinge portions (not shown), and the opening 25 can be closed by this cover 30. Retaining holes 31 are formed respectively in opposite side surfaces of the cover 30 at a distal end portion thereof, and retaining projections 32 are formed respectively on opposite side surfaces of the lower connector housing 22 at the rear end portion thereof. When the cover 30 is moved into its closed position, the retaining projections 32 are retainingly engaged respectively in the retaining holes 31, thereby locking the cover 30.

As in the above-mentioned general structure, a plurality of partition walls (not shown) are formed on the rear portion of the upper surface (connecting surface) 22*a* of the lower connecting housing 22 so as to be opposed respectively to the plurality of partition walls 24 on the upper connector housing 21. A wire position-limiting projection (not shown) is formed between any two adjacent partition walls (not shown) as described above for the general structure.

Front retaining recesses 33 are formed respectively in opposite ends of the front portion of the upper surface (connecting surface) 22*a* of the lower connector housing 22. The front retaining recess 33 is identical in construction to the second front retaining recess 15 of the general structure, and therefore explanation thereof will be omitted. Rear retaining arms 34 of an elastic nature are formed respectively on the opposite side surfaces of the lower connector housing 22 at the rear portion thereof, and each of the rear retaining arms 34 has a rear retaining hole 35.

A positioning lock projection portion 36 is formed on a central portion of the upper surface (connecting surface) 22*a* of the lower connector housing 22, and extends from the front side thereof to the rear side thereof in the direction (forward-rearward direction) T of extending of the partition walls 24. This positioning lock projection portion 36 is gradually decreasing in width from its distal end surface to its proximal portion.

In the above construction, the press-connecting terminals 26 are received respectively in the terminal storage chambers 23 in the two connector housings 21 and 22, and one end portions of the wires W are connected to these press-connecting terminals 26, respectively. Thereafter, the opening 25 in the lower connector housing 22 is closed by the cover 30.

Then, as shown in FIG. 3, the upper connector housing 21 is set in a recess 41 in a combining jig 40, with the lower surface 21*a* thereof directed upwardly, and the lower connector housing 22 is placed on the thus set upper connector housing 21 from the upper side, with the upper surface 22*a* thereof directed downwardly. When placing the lower connector housing on the upper connector housing, the front retaining projections 27 and the rear retaining projections 28 of the upper connector housing 21 are generally positioned relative to the front retaining recesses 33 and the rear retaining arms 34 of the lower connector housing 22, respectively, and also the front end of the positioning lock projection portion 36 on the lower connector housing 22 is generally positioned relative to the front end of the positioning recess 29 in the upper connector housing 21.

Then, a pressing member 42 of the combining jig 40 is moved downward to press the lower connector housing 22 downward. Thus, the lower connector housing 22 is moved downward by this pressing force, so that the opposed connecting surfaces of the two connector housings 21 and 22 are moved toward each other, and therefore in this connecting position, the front retaining projections 27 are fitted respectively into the front retaining recesses 33, and also the rear retaining projections 28 are retainingly engaged respectively in the rear retaining holes 35 since the rear retaining arms 34 are elastically deformed. Here, at an initial stage of the connecting operation, the pair of front retaining projections 27 on the upper connector housing 21 are guided respectively by the pair of (right and left) front retaining recesses 33, so that the front end portions of the two connector housings 21 and 22 are positioned relative to each other in the right-left direction and the forward-rearward direction, and therefore the insertion of the positioning lock projection portion 36 into the positioning recess 29 can be started smoothly as described below.

In accordance with the movement of the two connector housings 21 and 22 toward the connecting position, the positioning lock projection portion 36, formed on the upper surface (connecting surface) 22*a* of the lower connector housing 22, is gradually inserted into the positioning recess 29 formed in the lower surface (connecting surface) 21*a* of the upper connector housing 21, and this inserting operation continues until the two connector housings reach the connecting position.

Since the positioning lock projection portion 36 is thus continuously inserted into the positioning recess 29, the two connector housings 21 and 22 are moved to the connecting position without being displaced in a direction S perpendicular to the direction T of extending of the partition walls 24 (on the upper connector housing) and the partition walls (not shown, but formed on the upper surface of the lower connector housing), and therefore the partition walls (not shown) on the lower connector housing 22 are moved respectively toward the partition walls 24 on the upper connector housing 21 without being displaced relative thereto. Therefore, the distal end surfaces of the partition walls (not shown) on the lower connector housing 22 are substantially abutted respectively against the distal end surfaces of the partition walls 24 on the upper connector housing 21 without interfering the press-connecting terminals 26. Therefore, the short-circuiting between the adjacent press-connecting terminals 26 during the connecting operation is prevented.

The front retaining projections 27 are retainingly engaged in the front retaining recesses 33, respectively, and the rear retaining projections 28 are retainingly engaged respectively in the retaining holes 35 formed respectively in the rear retaining arms 34, and the positioning lock projection portion 36 is fitted in the positioning recess 29. In this manner, the two connector housings 21 and 22 are locked to each other.

In this embodiment, the positioning lock projection portion 36, gradually decreasing in width from its distal end surface to its proximal portion, is fitted in the positioning recess 29 gradually increasing in width from its open side to its bottom, and therefore the two connector housings, combined together, are effectively prevented from moving relative to each other.

In the above embodiment, the positioning recess 29 is formed in the lower surface (connecting surface) 21*a* of the upper connector housing 21, and extends from the front side thereof to the rear side thereof in the direction T of extending of the partition walls 24 (on the upper connector housing) and the partition walls (not shown, but formed on the lower connector housing), and the positioning lock projection portion 36 is formed on the upper surface (connecting surface) 22*a* of the lower connector housing 22, and extends from the front side thereof to the rear side thereof in the extending direction T. However, the positioning recess 29 and the positioning lock projection portion 36 may be formed continuously at least over a region where the partition walls 24 are substantially abutted respectively against the partition walls (not shown). When the positioning recess 29 and the positioning lock projection portion 36 are thus formed continuously at least over the region where the partition walls 24 are substantially abutted respectively against the partition walls (not shown), the partition walls (not shown) can be moved respectively toward the partition walls 24 without being displaced relative thereto. Although there are provided one positioning recess 29 and one positioning lock projection portion 36, there may be provided a plurality of positioning recesses 29 and a plurality of positioning lock projection portions 36, in which case the positioning recess or recesses 29 and the positioning lock projection portion or portions 36 may be provided at each of the two connector housings.

In the above embodiment, although the positioning recess 29 is formed in the upper connector housing 21 whereas the positioning lock projection portion 36 is formed on the lower connector housing 22, the positioning lock projection portion 36 may be formed on the upper connector housing 21 whereas the positioning recess 29 may be formed in the lower connector housing 22.

In the above embodiment, although the combined-type connector 20 includes the two (upper and lower) connector housings 21 and 22 stacked together, the invention can be applied to a combined-type connector including three or more connector housings stacked together.

As described above, the positioning lock projection portion is formed on one of the opposed connecting surfaces of the two connector housings, and continuously extends in the direction of extending of the partition walls at least over the region where the partition walls are substantially abutted respectively against the mating partition walls, and the positioning recess is formed in the other of the opposed connecting surfaces, and when the two connector housings are moved toward the connecting position, the positioning lock projection portion is engaged in the positioning recess. Therefore, when the opposed connecting surfaces of the two connector housings are moved toward each other, the positioning lock projection portion, formed on the connecting surface of one of the two connector housings, is gradually continuously inserted into the positioning recess formed in the connecting surface of the other connector housing. Since the positioning lock projection portion is thus continuously inserted into the positioning recess, the two connector housings are moved to the connecting position without being displaced in the direction perpendicular to the direction of extending of the partition walls, and therefore the partition walls on the one connector housing are moved respectively toward the partition walls on the other connector housing without being displaced relative thereto, and therefore the short-circuiting between the adjacent terminals during the connecting operation is prevented.

In the combined-type connector of the invention, the positioning lock projection portion is gradually decreasing in width from its distal end surface to its proximal portion, and the positioning recess is gradually increasing in width from its open side to its bottom. Thus, the positioning lock projection portion, gradually decreasing in width from its distal end surface to its proximal portion, is fitted in the positioning recess gradually increasing in width from its open side to its bottom, and therefore the two connector housings, combined together, are effectively prevented from moving relative to each other.

What is claimed is:

1. A combined-type connector comprising:

at least first and second connector housings being respectively provided with first and second terminal storage chambers, said first and second connector housings being adapted to stack one on the other and having respective first and second connecting surface opposed to each other when said first and second connector housing are connected together;

first partition walls, on said first connecting housings, for defining said first terminal storage chambers;

second partition walls, on said second connecting housings, for defining said second terminal storage chambers;

first distal end surfaces of said first partition walls substantially abutted respectively against second distal end surfaces of said second partition walls when said first and second connector housing are connected together;

at least one positioning lock projection portion formed on said first connecting surface, said positioning lock projection portion extending in a direction in which each of said first partition walls extends, said positioning lock projection portion extending over at least a region where said first partition walls are substantially abutted against said second partition walls respectively;

at least one positioning recess portion formed on said second connecting surface, said positioning recess portion extending in said direction, said positioning recess portion, engageable with said at least one positioning lock projection portion, extending over at least a region where said second partition walls are substantially abutted against said first partition walls respectively.

2. A combined-type connector housing according to claim 1, wherein said positioning lock projection portion is gradually decreasing in width from a distal end surface to proximal portion of said positioning lock projection portion said positioning recess portion is gradually increasing in width from an open side to a bottom of said positioning recess portion.

3. A combined-type connector housing according to claim 1, wherein said positioning lock projection portion extends from a front side to a rear side of said first connecting housing, and said positioning recess portion extends from a front side to a rear side of said second connecting housing.

4. A combined-type connector housing according to claim 1, wherein said at least one positioning lock projection is partially engaged with said at least one positioning recess portion prior to a completed connection of said first connector housing to said second connector housing, and gradually engaged therewith entirely as said first connector housing is moved to establish said completed connection to said second connector housing.

5. The combined-type connector according to claim 1, wherein the second connector housing has a rear retaining projection; and the first connector housing has a portion defining a rear retaining hole, for engaging the rear retaining projection when the first and second connector housings are connected.

6. The combined-type connector according to claim 1, wherein the second connector housing has a front retaining projection; and the first connector housing has a portion defining a front retaining recess, for engaging the front retaining projection when the first and second connector housings are connected.

* * * * *